US010731940B2

(12) United States Patent
McMillan

(10) Patent No.: US 10,731,940 B2
(45) **Date of Patent: *Aug. 4, 2020**

(54) MUZZLE BRAKE DEVICE

(71) Applicant: James Eric McMillan, Macon, GA (US)

(72) Inventor: James Eric McMillan, Macon, GA (US)

(73) Assignee: U.S. Arms Company LLC, Macon, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/601,366

(22) Filed: Oct. 14, 2019

(65) Prior Publication Data

US 2020/0049443 A1 Feb. 13, 2020

Related U.S. Application Data

(63) Continuation-in-part of application No. 16/129,922, filed on Sep. 13, 2018, now Pat. No. 10,473,415, which is a continuation-in-part of application No. 15/671,797, filed on Aug. 8, 2017, now Pat. No. 10,088,262, which is a continuation of application No. 15/615,388, filed on Jun. 6, 2017, now abandoned.

(60) Provisional application No. 62/399,994, filed on Sep. 26, 2016.

(51) Int. Cl.

| | |
|---|---|
| ***F41A 21/36*** | (2006.01) |
| ***F41A 21/28*** | (2006.01) |
| *F41A 21/32* | (2006.01) |
| *F41A 21/38* | (2006.01) |

(52) U.S. Cl.
CPC ..... *F41A 21/36* (2013.01); *F41A 21/28* (2013.01); *F41A 21/32* (2013.01); *F41A 21/38* (2013.01)

(58) Field of Classification Search
CPC ..... F41A 21/32; F41A 21/34; F41A 21/36; F41A 21/28
USPC ..... 89/14.3, 14.2
See application file for complete search history.

(56) References Cited

U.S. PATENT DOCUMENTS 2,567,826 A * 9/1951 Emilien ..... F41A 21/36 89/14.3
5,476,028 A * 12/1995 Seberger ..... F41A 21/36 89/14.3

(Continued)

FOREIGN PATENT DOCUMENTS

RU 2506515 C1 * 2/2014

*Primary Examiner* — Jonathan C Weber
(74) *Attorney, Agent, or Firm* — Jason T. Daniel, Esq.; Daniel Law Offices, P.A.

(57) ABSTRACT

A muzzle brake device includes a main body having a receiver opening, a discharge opening, a central bore, and a plurality of discharge channels extending outward from the central bore at locations between the receiver opening and the discharge opening. A plurality of raised inlet members are disposed along the central bore and are in communication with the plurality of discharge channels. A separation distance between the channels is complementary to the length of the projectile to which the weapon on which the device is attached, and each of the discharge channels are arranged to emulate the vane of a turbine engine, so as to produce a mechanical force that counteracts the recoil of the weapon to which the device is attached.

19 Claims, 7 Drawing Sheets

(56) References Cited

U.S. PATENT DOCUMENTS

| | | | | |
|---|---|---|---|---|
| 6,216,578 | B1 * | 4/2001 | Ledys | F41A 21/36 89/14.3 |
| 6,276,251 | B1 * | 8/2001 | Downing | F41A 21/36 89/14.3 |
| 7,032,339 | B1 * | 4/2006 | Bounds | F41A 21/36 42/1.06 |
| 8,424,440 | B1 * | 4/2013 | Carson | F41A 21/36 89/14.3 |
| 2008/0083321 | A1 | 4/2008 | Dueck et al. | |
| 2010/0269387 | A1 * | 10/2010 | Drajan | F41A 21/36 42/1.06 |
| 2016/0363404 | A1 | 12/2016 | Geissele | |

* cited by examiner

MUZZLE BRAKE DEVICE

CROSS-REFERENCE TO RELATED APPLICATIONS

This application claims the benefit of U.S. application Ser. No. 16/129,922 filed on Sep. 13, 2018, U.S. application Ser. No. 15/671,797 filed on Aug. 8, 2018; U.S. application Ser. No. 15/615,388 filed on Jun. 6, 2017; and U.S. Application Ser. No. 62/399,994 filed on Sep. 26, 2016, the contents of each of which are incorporated herein by reference.

TECHNICAL FIELD

The present invention relates generally to muzzle brakes for firearms, and more particularly to a muzzle brake for reducing recoil and reducing muzzle rise.

BACKGROUND

The statements in this section merely provide background information related to the present disclosure and may not constitute prior art.

One common problem associated with shooting firearms is the tendency for the firearm to recoil or kick as a result of rapid expansion and propulsion of gases from the firearm during and after firing. The forces and torque generated by propellant gas during firing generally push the muzzle back toward the shooter and have a tendency to push the distal end of the muzzle upward, thereby forcing the shooter to adjust and re-aim after every shot.

As such, when firing an automatic or semi-automatic weapon, the recoil phenomenon is compounded, as the muzzle will recoil incrementally with each shot, causing the barrel to move farther and farther off target. Such a situation thereby makes it extremely difficult for the shooter to engage in highly accurate rapid fire, as may be required in combat situations.

Although there are known muzzle brakes in the art, each of these devices are designed and constructed in a "one shape fits all" approach, that does not take full advantage of the energy of the propulsion gasses. To this end, these devices may be functional for some types of firearms but do little to improve the performance of others. The present invention directed to a muzzle brake device differs from the conventional art in a number of aspects. The manner by which will become more apparent in the description which follows, particularly when read in conjunction with the accompanying drawings.

SUMMARY OF THE INVENTION

The present invention is directed to a muzzle brake device. One embodiment of the present invention can include a main body having a receiver opening, a discharge opening, a central bore, and a plurality of discharge channels extending outward from the central bore at locations between the receiver opening and the discharge opening.

One embodiment of the present invention can include a plurality of raised inlet members that are disposed along the central bore and that are in communication with the plurality of discharge channels.

One embodiment of the present invention can include a separation distance between the channels that is complementary to a length of a projectile being fired from the weapon to which the device is attached.

In one embodiment of the present invention, each of the discharge channels can be designed to emulate the vane of a turbine engine, so as to produce a mechanical force that counteracts the recoil of the weapon to which the device is attached.

In one embodiment of the present invention, at least one of the raised inlet members is designed to produce a mechanical force that counteracts the upward trajectory of the weapon muzzle to which the device is attached.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
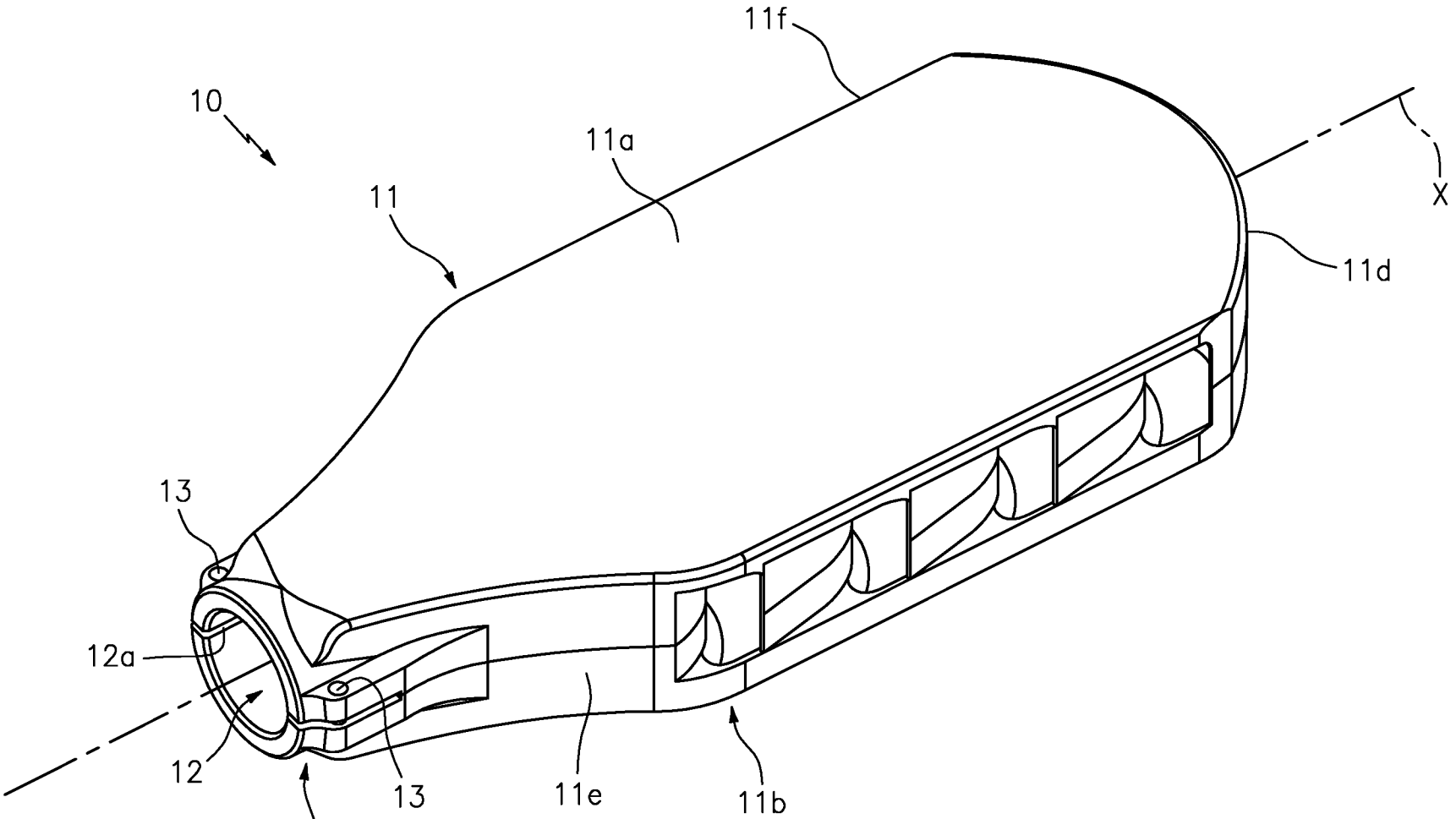
FIG. 1 is a perspective view of a muzzle brake device, in accordance with one embodiment that is useful for understanding the inventive concepts disclosed herein.
Figure 2:
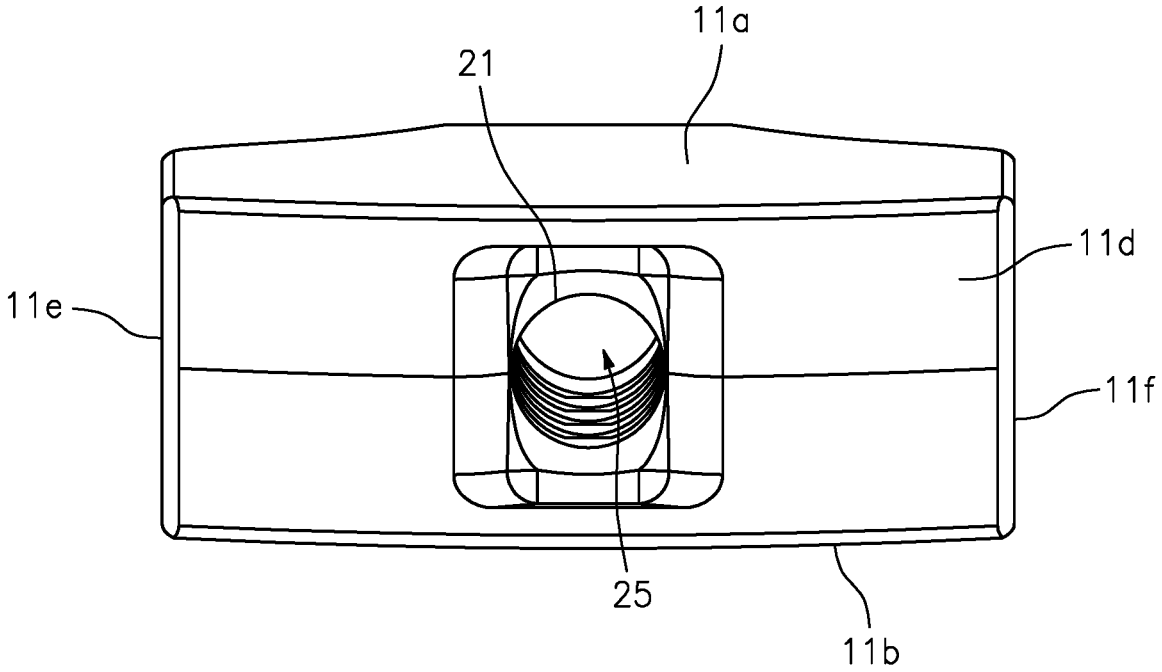
FIG. 2 is a distal end view of the muzzle brake device, in accordance with one embodiment of the invention.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As described throughout this document, the term "complementary shape," and "complementary dimension," shall be used to describe a shape and size of a component that is identical to, or substantially identical to, the shape and size of another identified component. For example, a substantially identical dimension may include tolerances of between 0.25 mm and 2 mm, for example.

As described herein, the terms "firearm" and "weapon" can be used interchangeably to describe any type of device capable of discharging ammunition. Several nonlimiting examples include: handguns, rifles, shotguns, artillery, and cannons, for example. Likewise, the term "ammunition" can include any type of projectiles which can be discharged by a firearm utilizing a propellant. Several nonlimiting examples include shotgun shells, ball bullets, boattail bullets, and sabot rounds, for example.

Through extensive research and development, the inventors of the below described device have discovered a novel structural arrangement for a muzzle brake device that is capable of sequentially channeling the propellant gas away from the weapon in a manner that significantly reduces recoil, reduces the upward motion of the muzzle, does not interfere with the operation of night vision equipment, or reduce the accuracy of the weapon.

FIGS. 1-6C illustrate one embodiment of a muzzle brake device 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As shown in FIGS. 1-4, the device 10 can include an elongated main body 11 having a top surface 11*a*, a bottom surface 11*b*, a proximal end 11*c*, a distal end 11*d* and a pair of opposing sides 11*e* and 11*f*. The main body can be constructed from any number of different materials that are relatively strong and stiff for their weight. In the preferred embodiment, the main body can be constructed from metals suitable for use in extremely high temperature environments, such as steel, titanium, or alloys thereof; however, other embodiments are contemplated wherein different lightweight and heat resistant materials such a ceramic, for example, may be utilized. Moreover, any number of heat resistant coatings and secondary materials can be added to, or embedded within the construction of the device, in accordance with known manufacturing techniques.

As described herein, the main body may be formed together from two substantially identical top and bottom halves so as to form one continuous element, either through manufacturing processes, such as welding, casting, or molding. Conversely, the main body may also be manufactured from a singular piece of material that is cast, milled or machined with the below described components forming identifiable sections thereof.

In either instance, the main body can include a receiver opening 12 that is disposed along the center portion of the proximal end 11*c*. In one embodiment, a plurality of screw threads 12*a* can be positioned within the receiver opening 12 and can function to mate with corresponding screw threads on the muzzle end of a firearm barrel to which the device is to be secured. Additionally, a pair of threaded apertures 13 can be positioned along the proximal end of the main body on opposite sides of the opening 12. The threaded apertures can function to receive hardware, such as crush washers or set screws, for example, which can be tightened once the main body is secured onto a firearm muzzle. Such a feature can act to reduce the inside diameter of the first opening, so as to allow a user to secure the device onto a firearm muzzle with the outlets of the below described channels positioned horizontally during device operation.

In one embodiment, a discharge opening 21 can be disposed along the center portion of the distal end 11*d* of the main body. Openings 12 and 21 can be in open communication with a central bore 25 that is disposed at the center of the main body along the longitudinal axis X thereof, and function to allow a projectile to enter and exit the device 10.

As described herein, the central bore 25 can be constructed to comprise an elongated channel having an inside diameter that is complementary to the outside diameter of a projectile being fired from the weapon to which the device 10 is to be secured. In this regard, each brake device 10 can be manufactured to be utilized with a particular type/caliber weapon.

Figure 3:
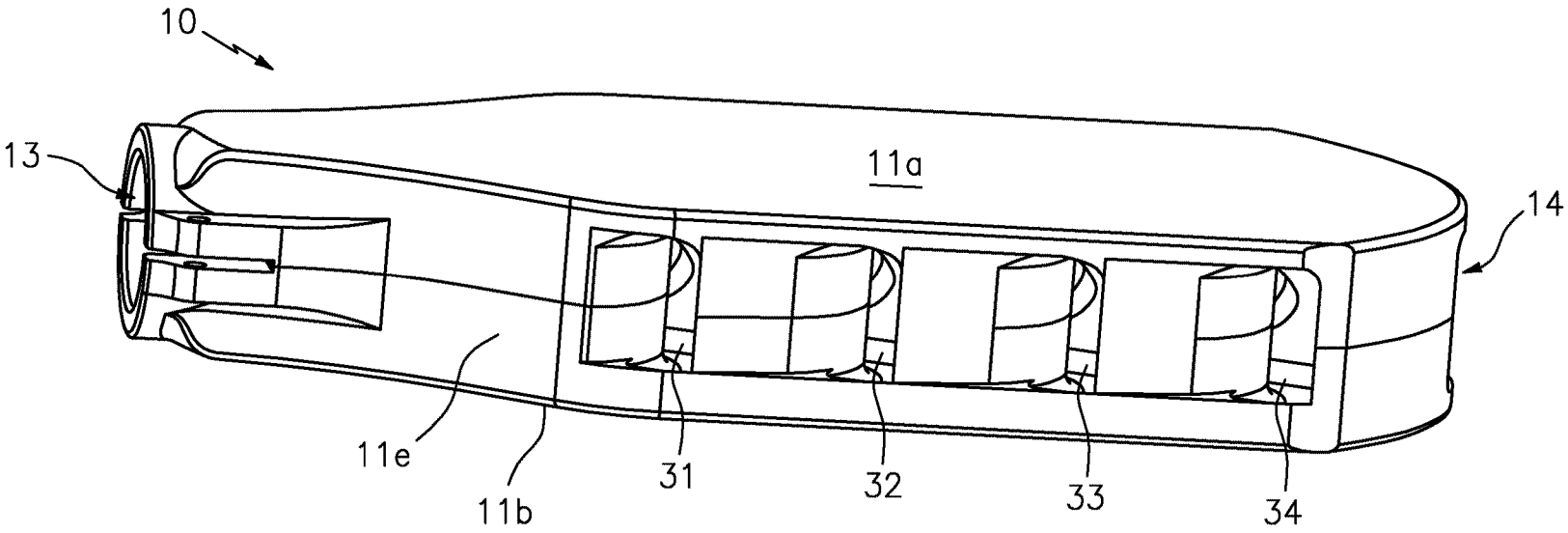
FIG. 3 is a right side view of the muzzle brake device, in accordance with one embodiment of the invention.
Figure 4:
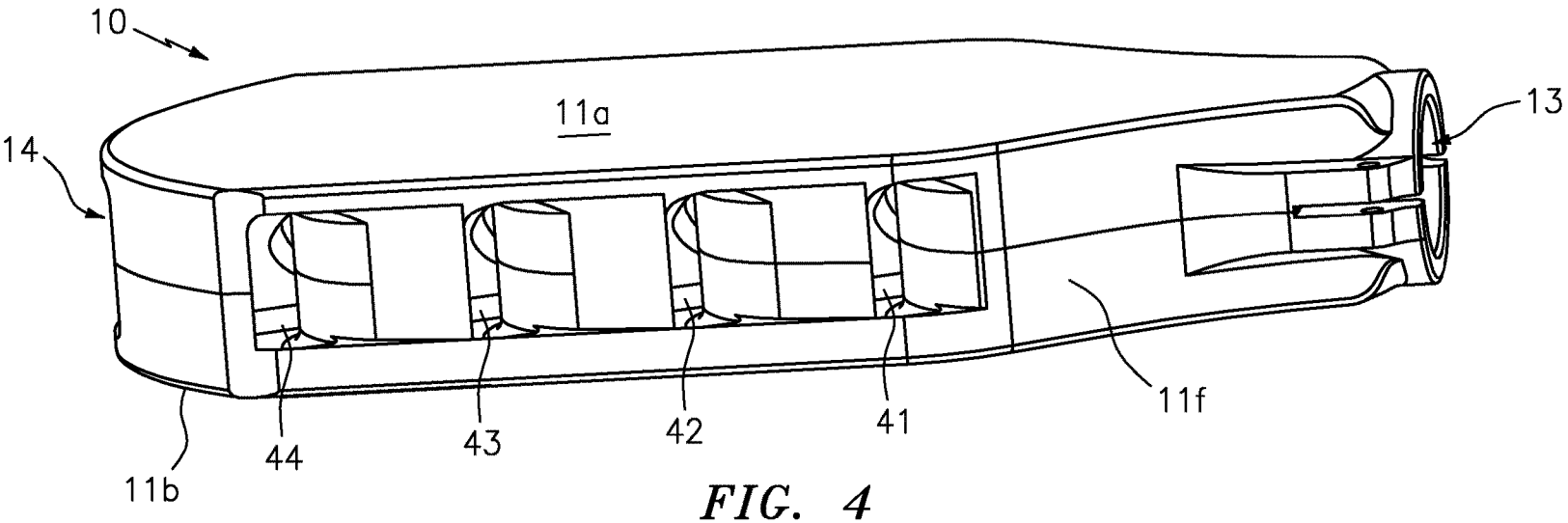
FIG. 4 is a left side view of the muzzle brake device, in accordance with one embodiment of the invention.
Figure 5:
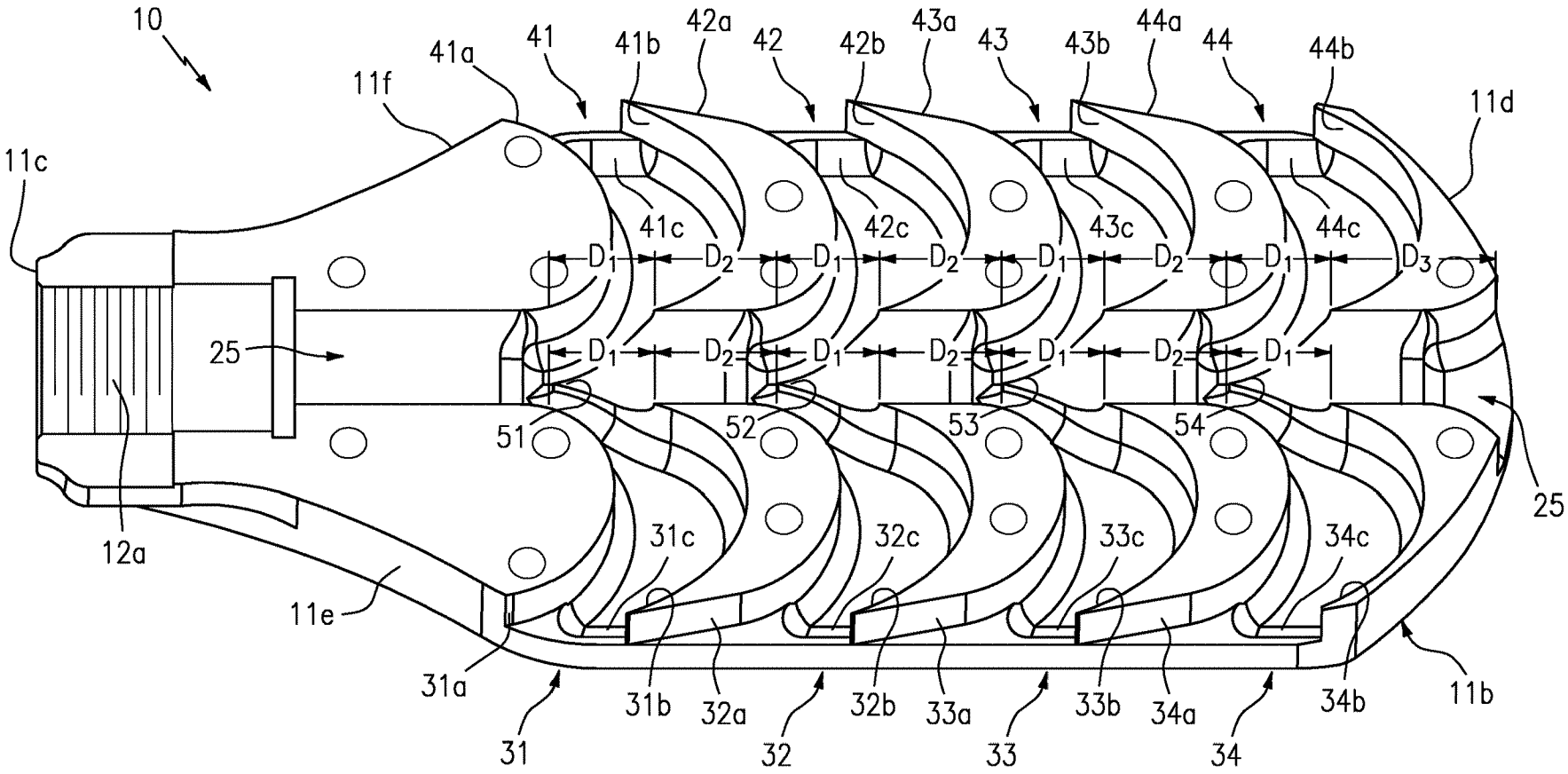
FIG. 5 is a cross sectional view of the muzzle brake device, in accordance with one embodiment of the invention.

As shown in FIGS. 3-5, a plurality of curved channels 31, 32, 33, 34, and 41, 42, 43, 44 can be disposed along the main body on either side of the central bore 25, in a mirror image relationship to each other. Each of the channels including a gas inlet section that is located within the central bore 25, and a gas discharge section that is located along one side of the main body 11*e* or 11*f*.

In various embodiments, each of the channels can include a cross sectional dimension/width that is uniform along the entirety of the channel extending from the gas inlet section to the gas discharge section. Conversely, other embodiments are contemplated wherein one or more of the channels include a cross sectional dimension/width that varies between the gas inlet section and the gas discharge section.

More specifically, one embodiment of the muzzle brake can include channels having a gas inlet section that is narrower than the gas discharge section. Such an arrangement can provide several advantages over traditional muzzle brake designs. For example, having a gas inlet section that is narrower than the gas discharge section advantageously reduces the restriction on the gas flow, allowing a larger percentage of the gasses to be used to mitigate recoil.

As will be described below, the inventors have discovered a calculation for maximizing the energy recovery of the rifle using the muzzle brake device. To this end, in one preferred embodiment, each of the channels can include an inlet opening distance D1 that is approximately 87.5% of the length of the projectile to be fired, and each channel can be separated by a distance D2 that is complementary to the length of the projectile being fired from the weapon to which the device 10 is secured. Such a feature acts to create a valving effect that sequentially channels a high percentage e.g., 90-100%, of the propellant gas through the channels.

In another embodiment, each of the channels can include an inlet opening distance D1 that is complementary to the length of the projectile to be fired. Such a feature also acts to create a valving effect that sequentially channels a high percentage e.g., 90-100%, of the propellant gas through the channels.

In one embodiment, the distal end of the central bore located adjacent to channels 34 and 44 can include a longer distance D3 than the other channel distances D2. In the preferred embodiment, D3 will be between 1.5 and 3 times the length of D2, so as to ensure any remaining propellant gas is scavenged by the distal channels 34 and 44, thereby further reducing the amount of propellant gas exiting the discharge opening 21.

As shown, each of the channels can be formed from a pair of upstanding sidewalls 31*a*-31*b*, 32*a*-32*b*, 33*a*-33*b*, 34*a*-34*b*; and 41*a*-4*b*, 42*a*-42*b*, 43*a*-43*b*, 44*a*-44*b*, respectively. In one embodiment, the middle and discharge ends of each of the sidewalls can extend from the top end of the main body 11*a* to the bottom end of the main body 11*b*.

In one embodiment, each of the upstanding sidewalls can include a height that is complementary to the diameter of the projectile traveling through the central bore. In one embodiment, the sidewalls can include a height that is greater than the diameter of the projectile so as to be taller than the projectile traveling through the central bore.

As shown best at FIG. 5, the inlet end of each of the sidewall sections 31*b*-41*b*, 32*b*-42*b*, 33*b*-43*b* and 34*b*-44*b* can be tapered, so as to gradually reduce in height from the top and bottom ends of the main body, so as to form slightly raised tip sections 51-54, respectively, along the center of the central bore 25. Such a feature acting to divert the propellant gasses towards the channels. Moreover, the discharge portion of the channels can include angled sections 31*c*-34*c* and 41*c*-44*c* that extends upward from the bottom surface 11*b* at an angle of approximately 5°. Such a feature creating a mechanical force pushing downward that counteracts muzzle rise. Of course, other angles are also contemplated.

As is further shown, each of the channels 31-34 and 41-44 can be formed to define an angle with a transverse axis or radius of the main body axis X. To this end, channels 31-34 can include a channel inlet angle of between 270-360 degrees, and a channel discharge angle of between 180-270 degrees, relative to the X-axis. Likewise, channels 41-44 can include a channel inlet angle of between 0-90 degrees, and a channel discharge angle of between 90-180 degrees, relative to the X-axis. Such angles being referred to hereinafter as being "generally opposite" to the direction of the projectile being fired.

In the preferred embodiment, the discharge angle of channels 31-34 can be oriented approximately 135° relative to the major axis X, and channels 41-44 can be oriented approximately 225° relative to the major axis X of the body. Such features allow maximum savaging of the gas into the channels, while reversing the direction of flow of the gasses, thereby converting the energy of the gasses into a forward force.

Although described above with regard to a particular number, shape, orientation and/or angle of individual channels, this is for illustrative purposes only. As such, those of skill in the art will recognize that other embodiments of the muzzle brake device may be provided that have a different number, shape, orientation and/or angled channels.

Figure 6A:
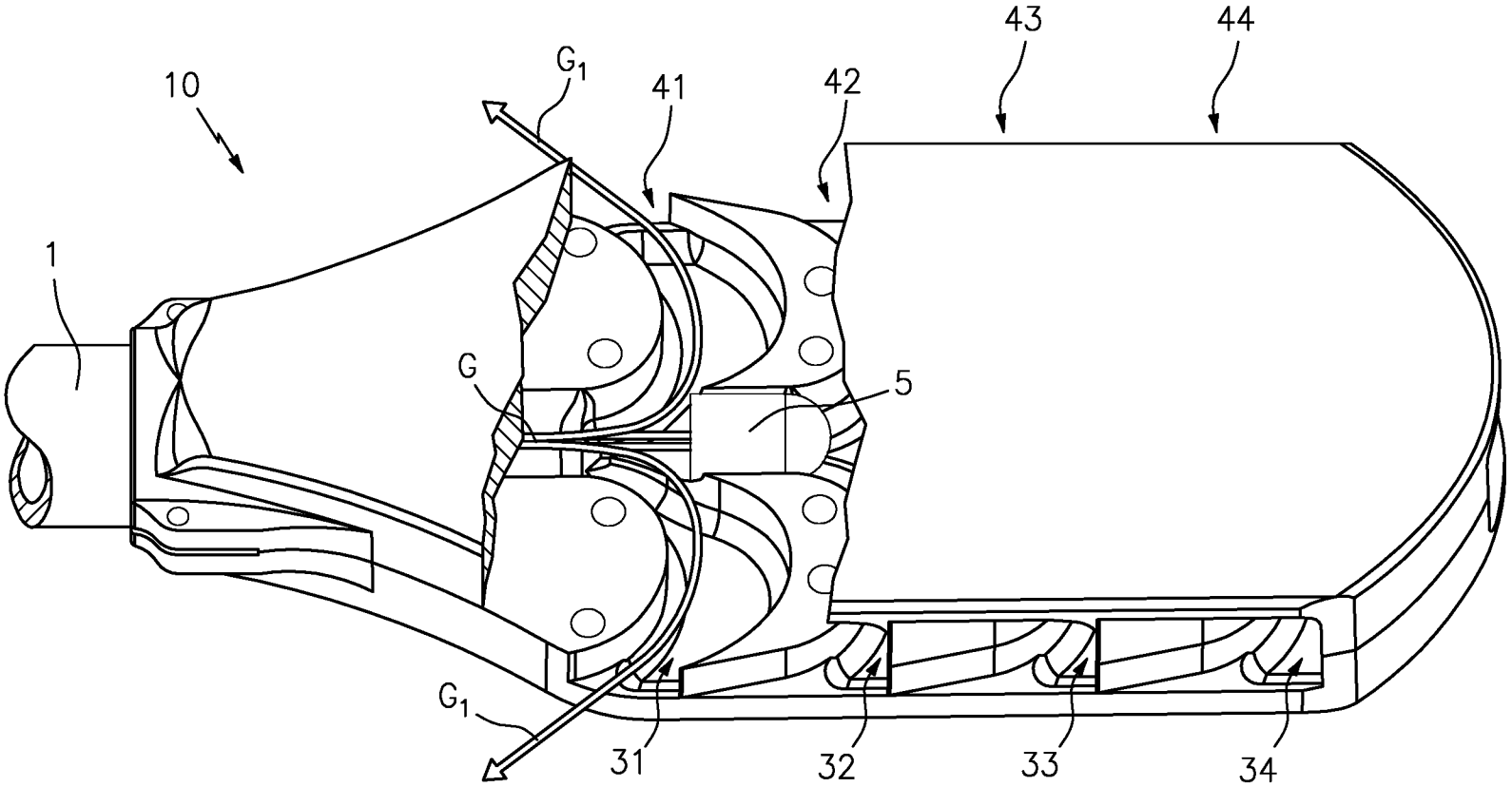
FIG. 6A is a perspective view of the muzzle brake device in operation, in accordance with one embodiment of the invention.
Figure 6B:
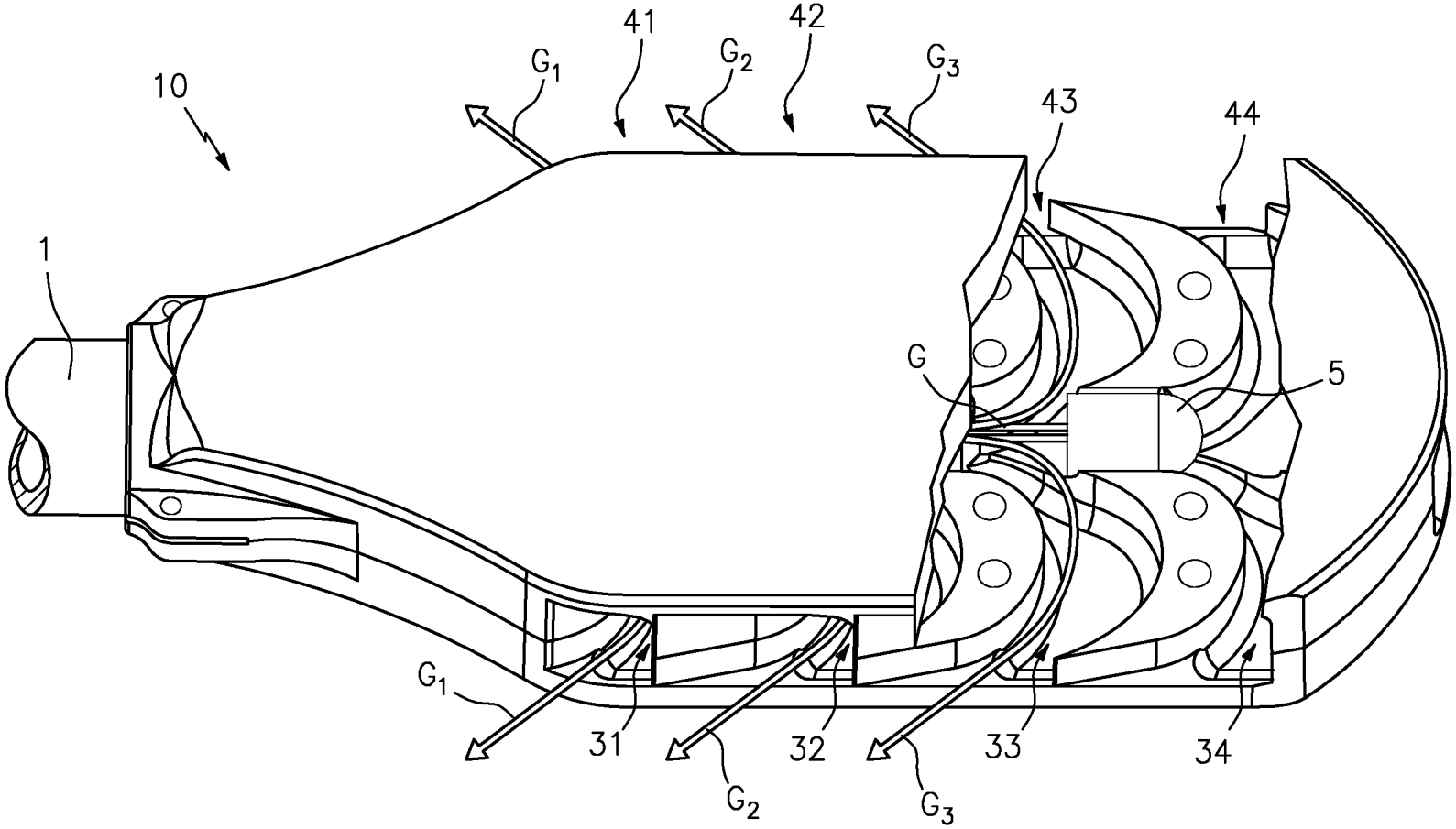
FIG. 6B is another perspective view of the muzzle brake device in operation, in accordance with one embodiment of the invention.
Figure 6C:
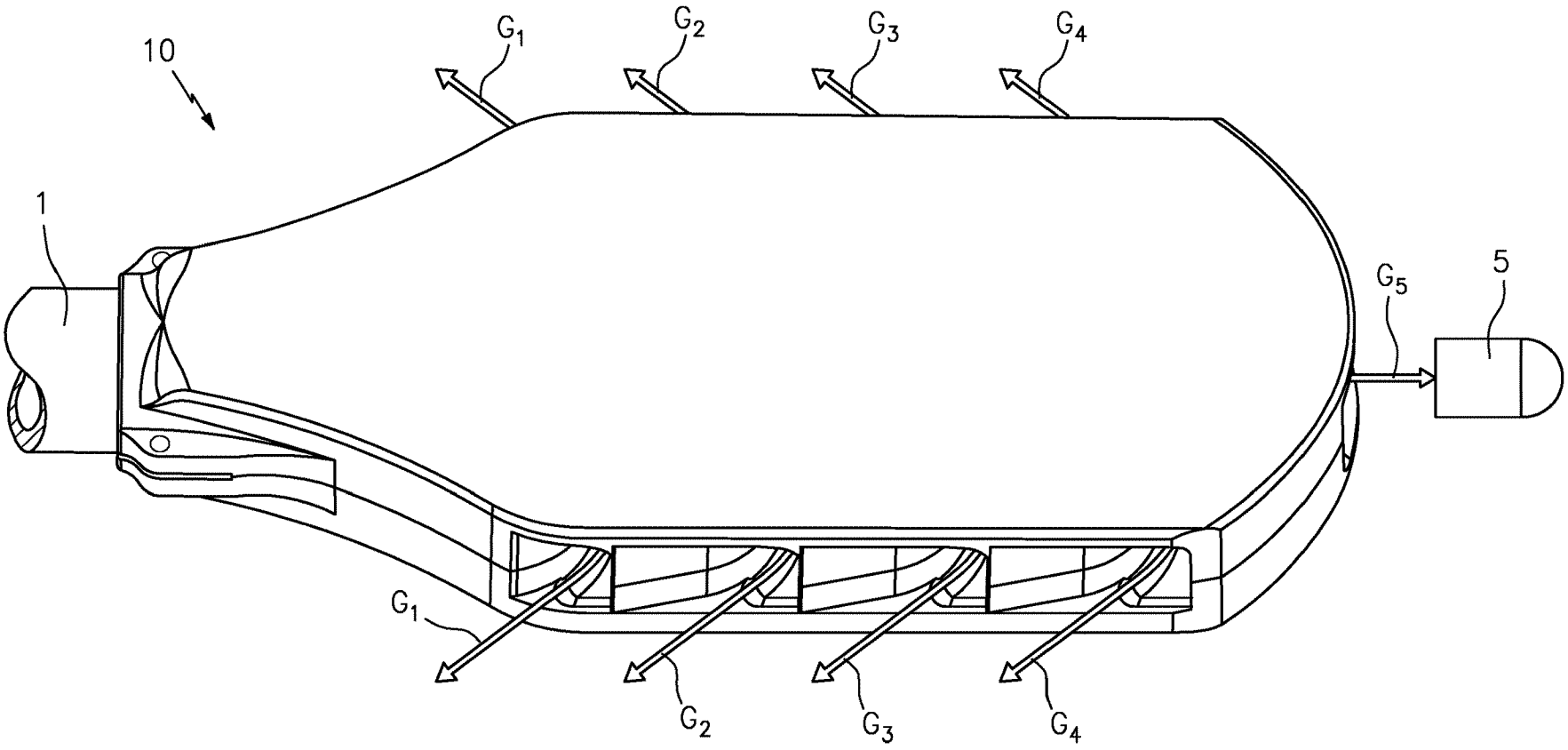
FIG. 6C is another perspective view of the muzzle brake device in operation, in accordance with one embodiment of the invention.

FIGS. 6A-6C illustrate one embodiment of the muzzle brake device 10 in operation. As shown, a projectile 5 can exit the muzzle 1 of a weapon to which the device 10 is secured and can travel along the length of the central bore 25. As the projectile encounters each set of horizontally aligned channels 31-41, 32-42, 33-43, 34-44, a valving effect occurs, wherein the propellant gas G is prevented from moving in front of the projectile and is sequentially diverted through the channels and discharged from the brake. As noted above, because each of the channels are oriented in a generally opposite direction to that of the projectile, the muzzle brake 10 functions to create a mechanical force that pushes the muzzle brake body (and the weapon to which it is attached) forward, thereby significantly reduce the recoil of the weapon.

Moreover, because the middle section of each channel extends forward/beyond the inlet portion, each channel is able to suck/scavenge the propellant gas G away from the central bore and the projectile being fired. Next, the curved nature of the channels can direct the gas in a generally opposite direction, before discharging the same. As such, each channel 31-34 and 41-44 functions in a similar manner to the vane of a turbine engine, wherein the high pressure gas formed by the propellant that is originally traveling in a first direction is routed into the inlet section of each channel, and is then expelled from the discharge section of each channel in a second direction. Such a feature results in the device 10 converting a significant majority of the propellant gas into mechanical energy that counteracts the rearward motion of the firearm barrel to which the device is attached, thus significantly reducing the recoil of the weapon.

As noted above, the central bore 25 preferably includes an internal diameter that is complementary to the projectile 5 being fired, and each of the channels preferably include a separation distance D that is complementary to the length of the projectile 5 being fired. As such, the muzzle brake design effectively prevents the propellant gas G from passing forward of the projectile 5 and allows the gas to be discharged by the channels in a sequential manner. Such a feature essentially creates a valving effect that sequentially discharges the gas in lessening amounts, wherein G1>G2>G3>G4.

Through extensive research and development, the inventor has discovered that sizing the channels of one embodiment of the muzzle brake to discharge the propellant gas at: G1=45%, G2=31%, G3=16%, G4=5%, G5=3% results in the maximum amount of produced mechanical energy to significantly reduce the recoil from the weapon. To this end, through the use of the above described plurality of channels (e.g., 31-34 and 41-44) the gas leaving the bore output (e.g., G5) can be between approximately 0% and 5%. Such a feature representing a significant departure from other known muzzle brake devices, as the entire amount of propellant gas can be utilized by the muzzle brake 10 to counteract recoil and muzzle rise.

Bench test comparisons of rifle recoil rates have demonstrated the muzzle brake device can consistently reduce weapon recoil within a 90-100% range. For example, in one bench test, a .223 rifle was fired multiple times without the muzzle brake device and incurred an average recoil distance of 4.25 inches. Conversely, when the same rifle was fired multiple times from the same bench with the muzzle brake device 10, the average recoil distance was 0.25 inches. Such an improvement constituted an average 94% reduction in weapon recoil.

As noted above, it is preferred that during device operation, each of the channels 31-34 and 41-44 maintain a planar relationship along a horizontal axis, so as to not dispense the propellant gas vertically. This is a feature that advantageously prevents the light generated by the propellant gas from entering the field of view of the weapon operator, in order to not affect their night vision while firing the weapon.

In one exemplary embodiment, the device 10 can include an overall length (e.g., distance between inlet opening 12 and outlet opening 21) of approximately 8.2 inches; a width (e.g., distance between sides 11*e* and 11*f*) of approximately 3.2 inches; an inlet opening distance D1 of approximately 0.85 inches, and a separation distance D2 between the channels of approximately 0.4 inches. Such dimensions being suitable for use with a .50 caliber firearm, such as a Barrett® .50 Cal rifle, for example.

Of course, the inventive concepts are not limited to the above described dimensions, and/or specifications, as many other embodiments are also contemplated wherein the muzzle brake 10 may be manufactured to include a greater or lesser number of overall channels, so as to be suitable for use with weapons capable of firing any type and/or size projectiles. For example, another embodiment of the muzzle brake device 10 may be manufactured with any number of individual channels each having a shape and size that are suitable for use with field artillery, airborne cannon, and/or battlefield weapons such as the 120 mm smooth bore cannon of a front line tank, for example.

As described herein, one or more elements of the muzzle brake device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A muzzle brake device for a firearm, comprising:

a main body having a proximal end, a distal end, a first side section, a second side section that is positioned opposite to the first side section, and a central bore that extends from the proximal end to the distal end;

a first set of channels that are positioned within the main body, each channel of the first set of channels being separated longitudinally by a first distance, and comprising a gas inlet section that is in communication with the central bore, and a gas discharge section that is in communication with the first side section; and a second set of channels that are positioned within the main body, each channel of the second set of channels being separated longitudinally by a second distance, and comprising a gas inlet section that is in communication with the central bore, and a gas discharge section that is in communication with the second side section, wherein the central bore includes a diameter that is complementary to an outside diameter of a projectile to travel along the central bore, and each of the first and second set of channels function to direct at least 60% of a projectile's gas away from the central bore and toward the proximal end of the main body.

2. The device of claim 1, wherein a recoil energy of a firearm to which the muzzle brake device is secured is reduced by 80%.

3. The device of claim 1, wherein at least 70% of the projectile's gas is directed at least 120 degrees from a travel direction of the projectile.

4. The device of claim 1, wherein at least 85% of the projectile's gas is directed at least 115 degrees from a travel direction of the projectile.

5. The device of claim 1, wherein at least 61% of the projectile's gas is directed at least 145 degrees from a travel direction of the projectile.

6. The device of claim 1, wherein each of the first distance and the second distance are complementary to a length of the projectile.

7. The device of claim 1, wherein one of the first distance and the second distance are greater than a length of the projectile.

8. The device of claim 1, wherein one of the first distance and the second distance are less than a length of the projectile.

9. The device of claim 1, wherein the inlet section of each channel of the second set of channels is oriented at an angle of between 0 and 90 degrees relative to a longitudinal axis of the main body.

10. The device of claim 9, wherein the discharge section of each channel of the second set of channels is oriented at an angle of between 90 and 180 degrees relative to the longitudinal axis of the main body.

11. The device of claim 1, wherein each channel of the first set of channels and the second set of channels define an angle with a transverse axis to a longitudinal axis of the main body.

12. The device of claim 1, wherein each channel of the first set of channels and the second set of channels includes a height that is greater than a diameter of the projectile to travel along the central bore.

13. The device of claim 1, wherein each channel of the first set of channels and the second set of channels includes a uniform cross sectional dimension extending between the gas inlet section and the gas discharge section.

14. The device of claim 1, wherein at least one channel of the first set of channels and the second set of channels includes a cross sectional dimension along the gas inlet section that is less than a cross sectional dimension along the gas discharge section.

15. The device of claim 1, wherein each channel of the first set of channels and the second set of channels includes a cross sectional dimension along the gas inlet section that is less than a cross sectional dimension along the gas discharge section.

16. The device of claim 1, wherein each channel of the first set of channels and the second set of channels includes a generally planar bottom wall, and further comprises:

an angled lip portion that is disposed along the discharge section, said lip portion extending upward from the bottom wall, said angled lip being configured to direct the discharging propellant gas upward to reduce muzzle rise.

17. The device of claim 1, wherein the first set of channels and the second set of channels each includes four individual channels that are arranged along the main body.

18. A muzzle brake device for a firearm, comprising:

a main body having a proximal end, a distal end, a first side section, a second side section that is positioned opposite to the first side section, and a central bore that extends from the proximal end to the distal end;

a first set of channels that are positioned within the main body, each channel of the first set of channels being separated longitudinally by a first distance, and comprising a gas inlet section that is in communication with the central bore, and a gas discharge section that is in communication with the first side section; and a second set of channels that are positioned within the main body, each channel of the second set of channels also being separated longitudinally by the first distance, and comprising a gas inlet section that is in communication with the central bore, and a gas discharge section that is in communication with the second side section, wherein the central bore includes a diameter that is complementary to an outside diameter of a projectile to travel along the central bore, and each of the first and second set of channels function to direct at least 50% of a projectile's gas away from the central bore and toward the proximal end of the main body.

19. The device of claim 18, wherein a recoil energy of a firearm to which the muzzle brake device is secured is reduced by 50%.

* * * * *